US007934552B2

(12) United States Patent
La Rovere

(10) Patent No.: US 7,934,552 B2
(45) Date of Patent: May 3, 2011

(54) METHOD AND APPARATUS FOR WELL CASING REPAIR AND PLUGGING UTILIZING MOLTEN METAL

(76) Inventor: Thomas La Rovere, Santa Barbara, CA (US)

( * ) Notice: Subject to any disclaimer, the term of this patent is extended or adjusted under 35 U.S.C. 154(b) by 315 days.

(21) Appl. No.: 11/516,847

(22) Filed: Sep. 6, 2006

(65) Prior Publication Data

US 2007/0051514 A1 Mar. 8, 2007

Related U.S. Application Data

(60) Provisional application No. 60/715,553, filed on Sep. 8, 2005.

(51) Int. Cl.
*E21B 29/10* (2006.01)

(52) U.S. Cl. ..... 166/277; 166/302; 166/60

(58) Field of Classification Search ..... 166/277, 166/302, 60, 169, 250.04
See application file for complete search history.

(56) References Cited

U.S. PATENT DOCUMENTS

| | | | | |
|---|---|---|---|---|
| 2,286,075 | A * | 6/1942 | Evans | 166/58 |
| 6,102,120 | A * | 8/2000 | Chen et al. | 166/287 |
| 2003/0132224 | A1 * | 7/2003 | Spencer | 219/635 |
| 2004/0149443 | A1 * | 8/2004 | La Rovere et al. | 166/302 |

* cited by examiner

*Primary Examiner* — David J Bagnell
*Assistant Examiner* — David Andrews

(57) ABSTRACT

Method and apparatus used to deploy and process eutectic metal alloy material into an oil, gas or water well for the purpose to plug and seal selected downhole casing leaks. The apparatus includes a power control unit located at surface and a downhole tool that is lowered into the well by standard wireline cable. The downhole tool delivers the necessary quantity of metal alloy, forms the required temporary bridge plug support for containing the molten alloy, melts the alloy by means of electric heating, heats the surrounding wellbore formation, squeezes the molten alloy through the perforations and recovers any excess alloy for subsequent recycling.

29 Claims, 12 Drawing Sheets

Alloy billet design

Top view

Profile view

Alloy pellets

Process Method Flowchart

METHOD AND APPARATUS FOR WELL CASING REPAIR AND PLUGGING UTILIZING MOLTEN METAL

This application claims priority of Provisional Application No. 60/715,553 filed on Sep. 8, 2005 by Thomas A. La Rovere, sole inventor.

CROSS-REFERENCE TO RELATED APPLICATIONS

Not applicable

REFERENCES CITED

U.S. Pat. No. 6,828,531 B2 Dec. 7, 2004 Spencer
U.S. Pat. No. 6,664,552 B2 Dec. 16, 2003 Spencer
U.S. Pat. No. 6,384,389 B1 May 7, 2002 Spencer

BACKGROUND

1. Field of Invention

This invention relates to equipment and methods of use for repairing cracks and plugging holes in the casing of operational wells using a molten metal alloy. The intention of the present invention is to plug said holes with a surface flush to the net inside diameter of the production casing.

The particular advantage of the present invention is that it provides a completely integrated tool that performs all processing in a single pass deployment by means of industry standard wireline cable; thereby eliminating the need for workover rigs, multiple tool deployments, the installation of temporary bridge plugs and the subsequent milling or drilling out of residual alloy material. The present invention is particularly suitable for precision plugging of intended perforations which enable fluid communication between the wellbore formation and the production casing and to repair damaged casings in otherwise operational wells caused by corrosion, abrasion, earth movement, pressure bursting or other destructive factors.

It is contemplated that the present invention is advantageous for use in shutting off selected intervals in gas wells.

2. Description of Prior Art

U.S. Pat. No. 6,828,531 B2 Dec. 7, 2004 Spencer describes the use of eutectic metal sealing for oil and gas wells using an electrical resistance or inductive heating tool and forcing the molten alloy through perforations and into the formation or the well cement for the repair of a fault, but does not contemplate or claim the method or means to remotely control the dispensing of controlled amounts of alloy into the heater. The invention does not contemplate, describe nor claim a method or apparatus for use in selective plugging of perforations in producing wells. In addition, the process described by Spencer requires the separate installation setting of a temporary bridge plug and the subsequent drilling out and removal of excess solidified alloy material and the bridge plug.

U.S. Pat. No. 6,664,552 B2 Dec. 16, 2003 Spencer describes the use of eutectic metal among other various materials useful for sealing leaks within annuli of well casings of oil and gas wells using an electrical resistance or inductive heating tool. The invention describes the injection of material separately through the annulus vent tube where the material to be melted is deposited within any annulus between the production and surface casing of the well and above the well cement between the casings of interest. The invention does not contemplate the flow of melted sealing material through perforations in the casings and into the formation or the annulus.

U.S. Pat. No. 6,384,389 B1 May 7, 2002 Spencer describes the use of eutectic metal among other various materials useful for sealing leaks within annuli of well casings of oil and gas wells using an electrical resistance or inductive heating tool. The invention describes the injection of material separately through the annulus vent tube where the material to be melted is positioned within any annulus between the production and surface casing of the well and above the well cement between the casings of interest. The invention does not contemplate the flow of melted sealing material through perforations in the casings and into the formation or the annulus.

Various other processes and methods are utilized by the oil and gas industry for plugging and sealing of well casings including cements, gels and resins, a number of which are cited by the Spencer patents referenced above.

BRIEF DESCRIPTION OF THE SEVERAL VIEWS OF THE DRAWING

FIG. 11-B illustrates alloy material supplied in pellet form.

REFERENCE NUMERALS IN DRAWINGS

Figure 1:
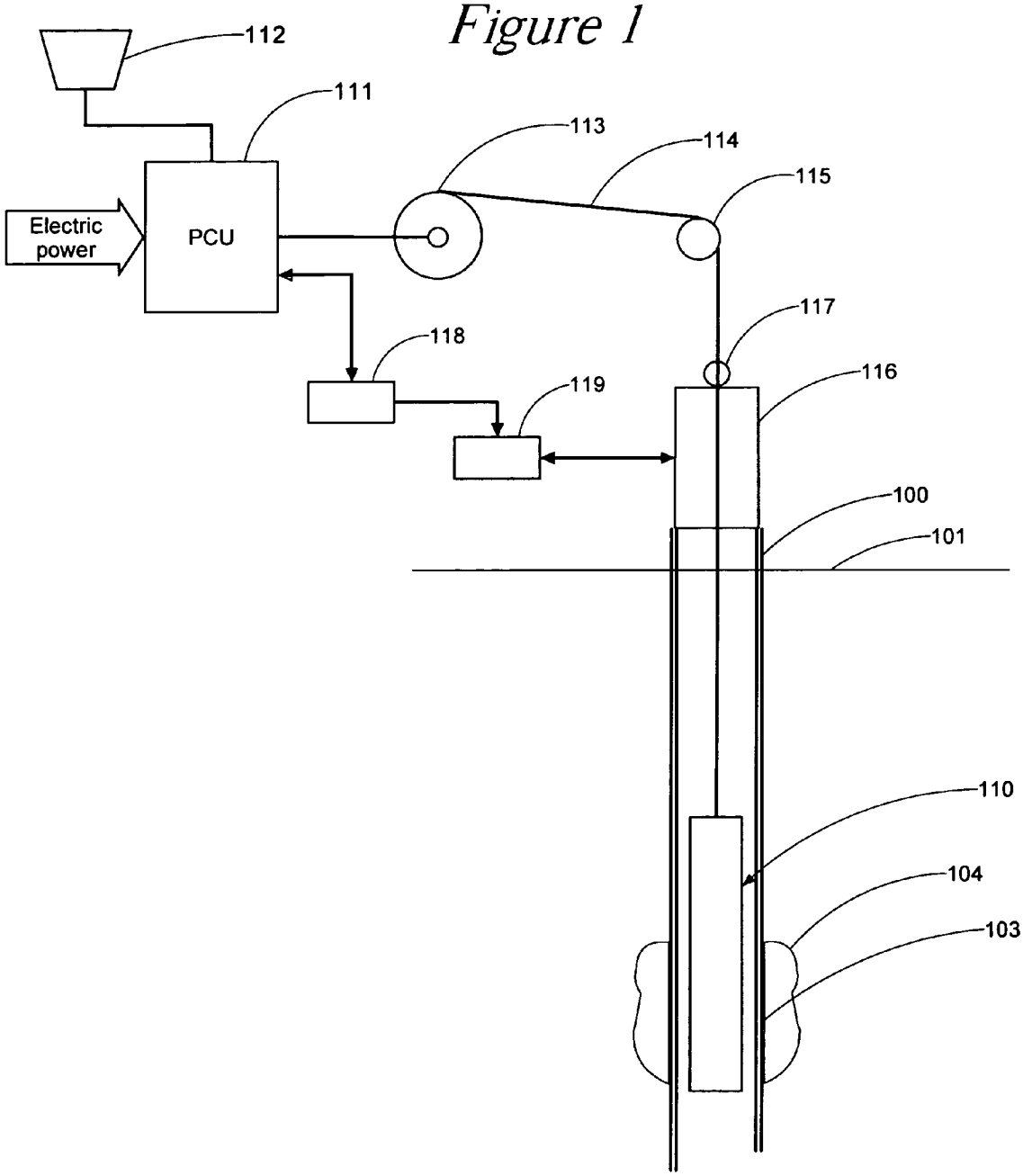
FIG. 1 is a system block diagram of overall equipment layout.

100 Well casing
101 Surface
102 Subsurface formation
103 Casing perforation
104 Perforation zone
110 Downhole tool
111 Power control unit (PCU)
112 Operator controls
113 Wireline spool
114 Wireline
115 Wireline pulley

116 Well lubricator
117 Sealing gland
118 External pressure source
119 External pressure valve
131 Wireline connector
132 Electrical control module
133 Hydraulics reservoir
134 Hydraulic pumps
135 Billet magazine loader
136 Alloy billet
137 Billet magazine
138 Billet dispenser
139 Dispense latch
140 Billet melting heating module
141 Alloy flow valve
142 Expansion collar
143 Zone heating module
144 Expansion squeeze sleeve
145 Expansion bridge
146 Temperature sensor
147 Level sensor
148 Inspection camera
149 Strain sensor
150 Vibration module
151 Overflow portal
160 Molten alloy

DESCRIPTION

FIGS. 1 Through 12

Preferred Embodiment

A preferred embodiment of the present invention is illustrated in FIGS. 1 through 12. FIG. 1 illustrates the general configuration of equipment including a power control unit (PCU) 111, operator controls 112, wireline spool 113 and wireline pulley 115 located at the surface 101 in proximity to the well casing 100; and the downhole tool 110 suspended by the wireline 114 and lowered to a desired depth position within the well casing 100. Typically the wireline is routed through a well lubricator device 116 mounted at the top of the well casing and passed through a sealing gland 117 to prevent gases from leaking from the well during the process. An external pressure source 118 and pressure valve 119 supplied at the well surface may also be incorporated to control pressure applied to the well casing to beneficially squeeze the molten alloy through the casing perforations and into the heated formation zone.

Figure 2:
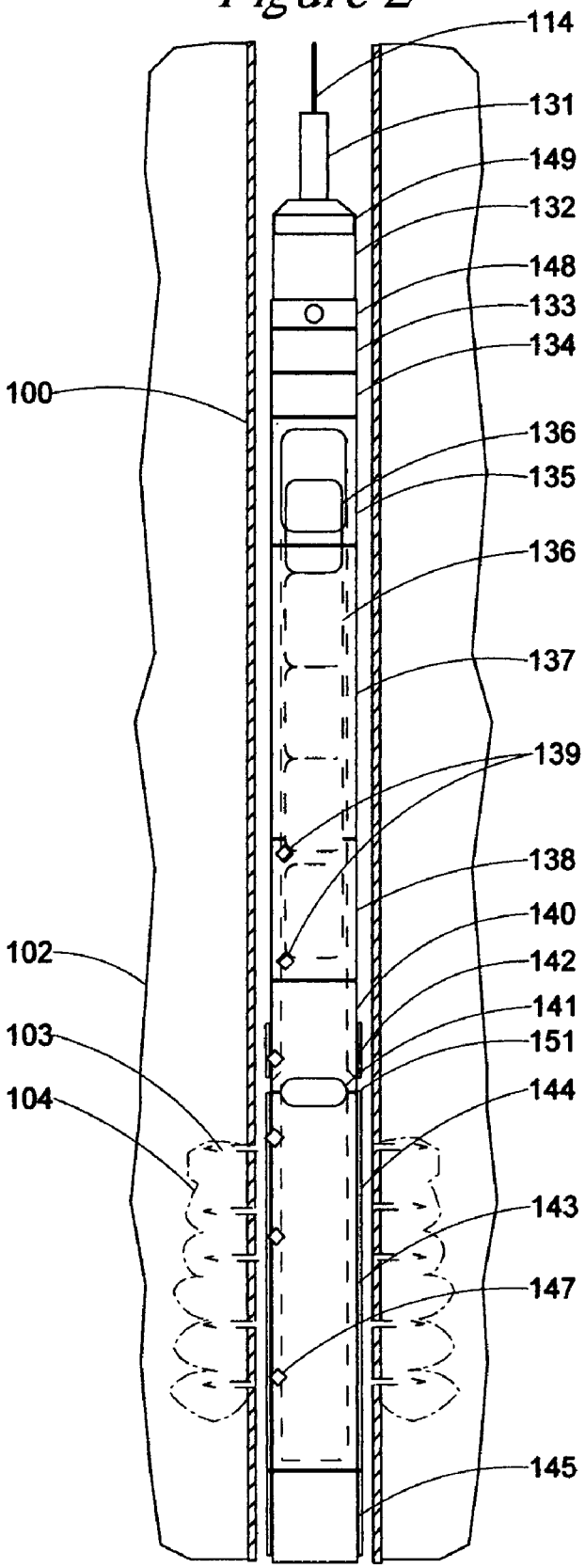
FIG. 2 is a diagrammatic cross sectional view of the entire downhole tool, as suspended by a wireline cable, and nominally positioned within the well production casing adjacent to the perforation zone.

FIG. 2 illustrates the downhole tool assembly 110 as suspended within the well casing 100 to a desired depth in vertical proximity to the casing perforation 103 to be plugged. The downhole tool 110 may conveniently be attached mechanically and electrically to the wireline 114 by means of a wireline connector 131. An electrical and electronic control module 132 is contained within a pressure vessel. An inspection camera 148 may be conveniently be integrated to allow remote visual inspection by an operator before and after the plugging process. The electronic controls may also conveniently integrate pressure sensors, temperature sensors and wireline strain sensors to provide useful real time process information to the operator.

Figure 3:
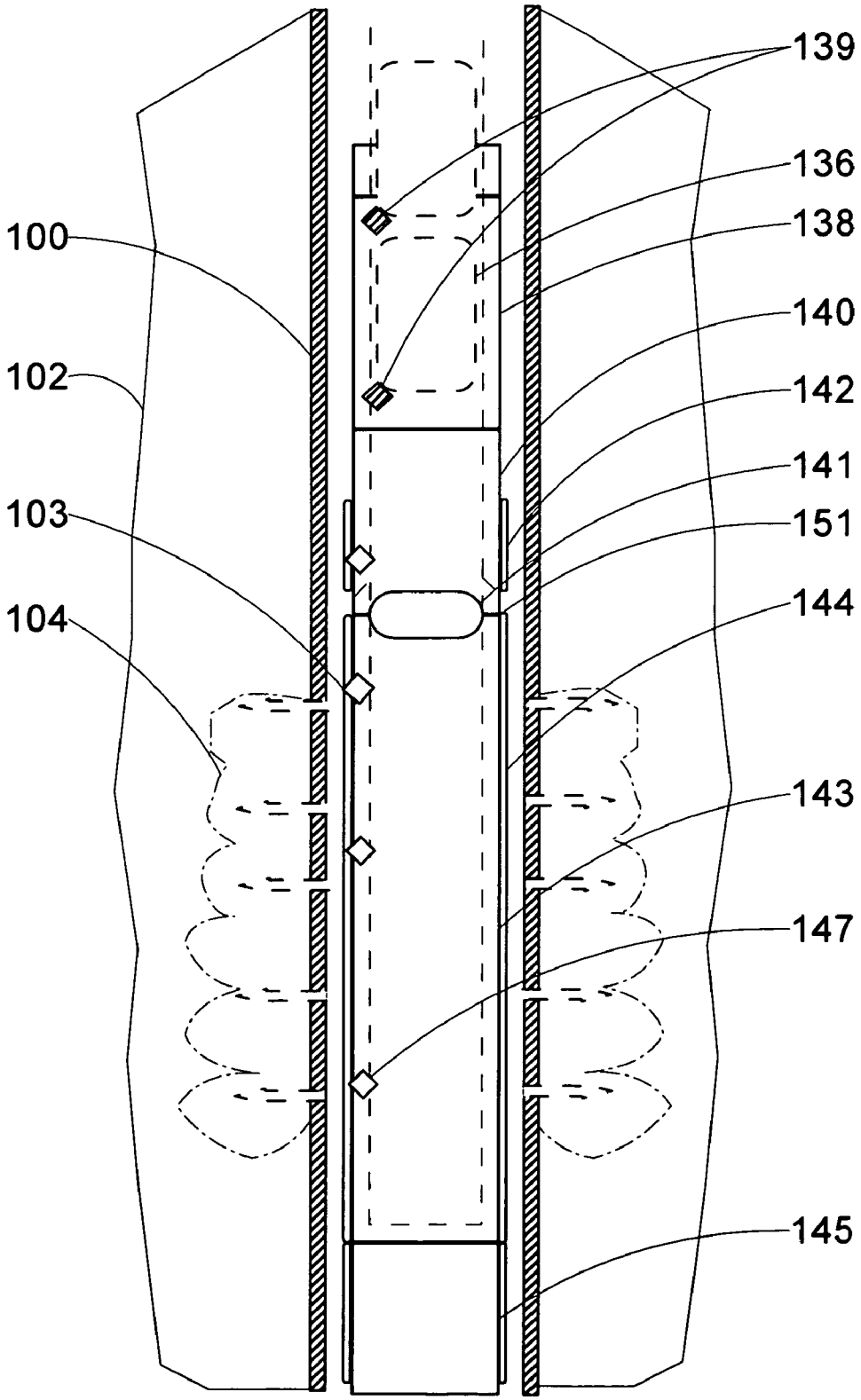
FIG. 3 is a diagrammatic cross view of the downhole tool plugging section.
Figure 4:
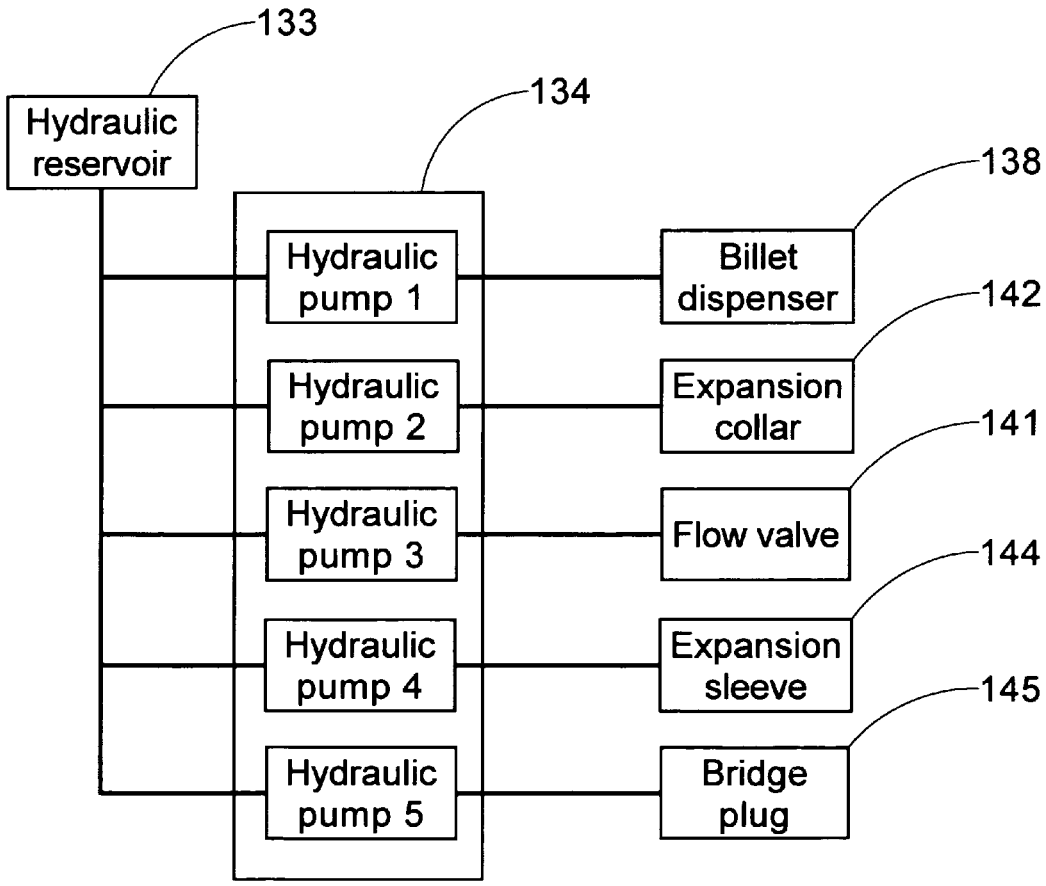
FIG. 4 is a system block diagram embodiment of a hydraulic system to actuate a molten alloy flow control valve, expansion collar, expansion squeeze sleeve and bridge plug.

FIGS. 3 and 4 illustrates a preferred embodiment of the downhole tool 110 utilizing an integrated hydraulic reservoir 133 and hydraulic pumps 134 to actuate the billet dispense latches 139, expansion and retraction of an expansion bridge plug 145, expansion collar 142, expansion squeeze sleeve 144 and the molten alloy flow valve 141. As an alternative to hydraulic power, expansion and retraction functions of the plug, collar, sleeve and valve could be accomplished using electromechanical actuators.

Figure 5:
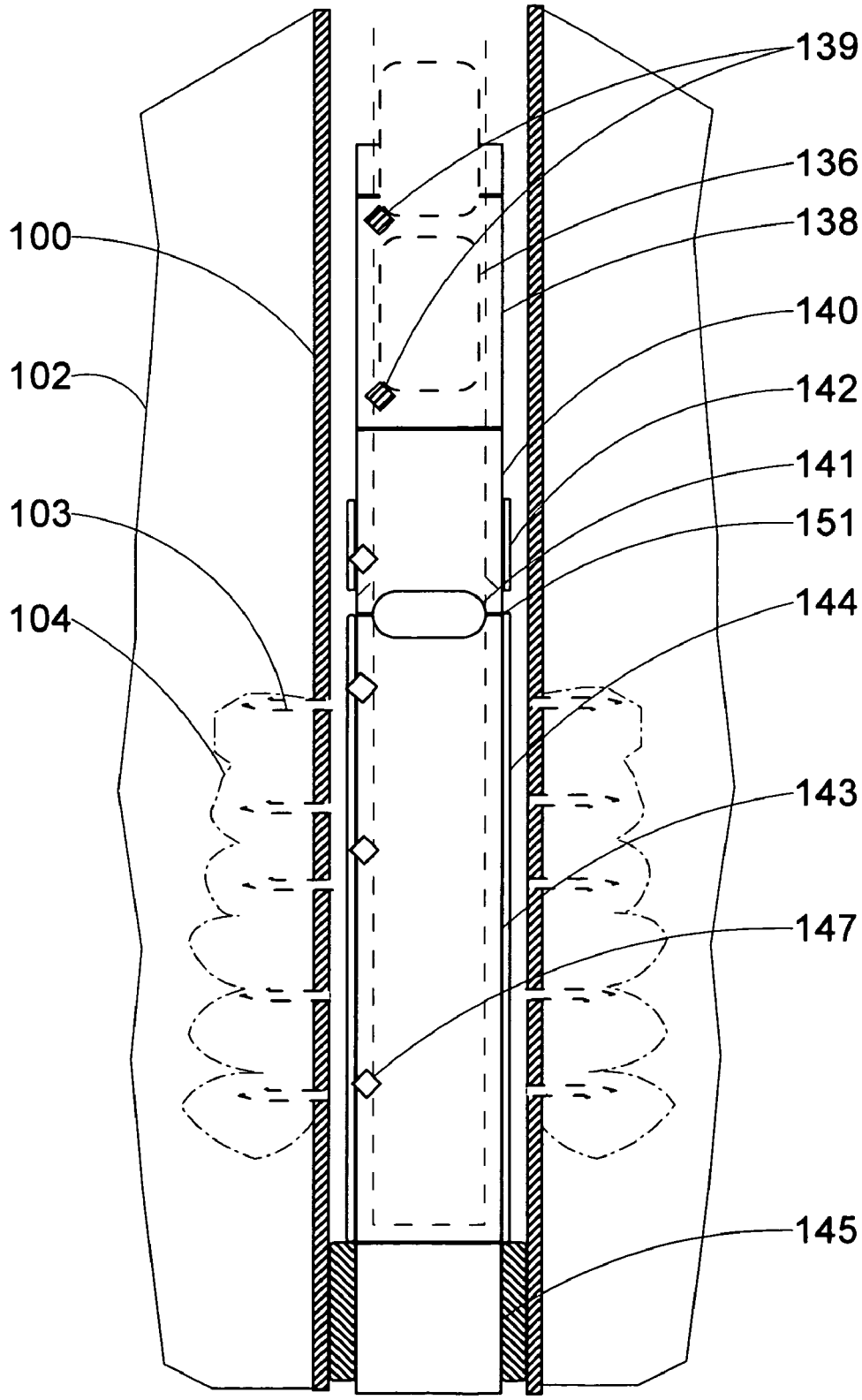
FIG. 5 illustrates the downhole tool with bridge plug set prior to melting alloy.

FIG. 5 illustrates the downhole tool 110 in the desired position; an alloy billet 136 dispensed into the billet melting heating module 140 and the expansion bridge plug 145 in the expanded condition prior to melting the alloy billets 136.

Figure 6:
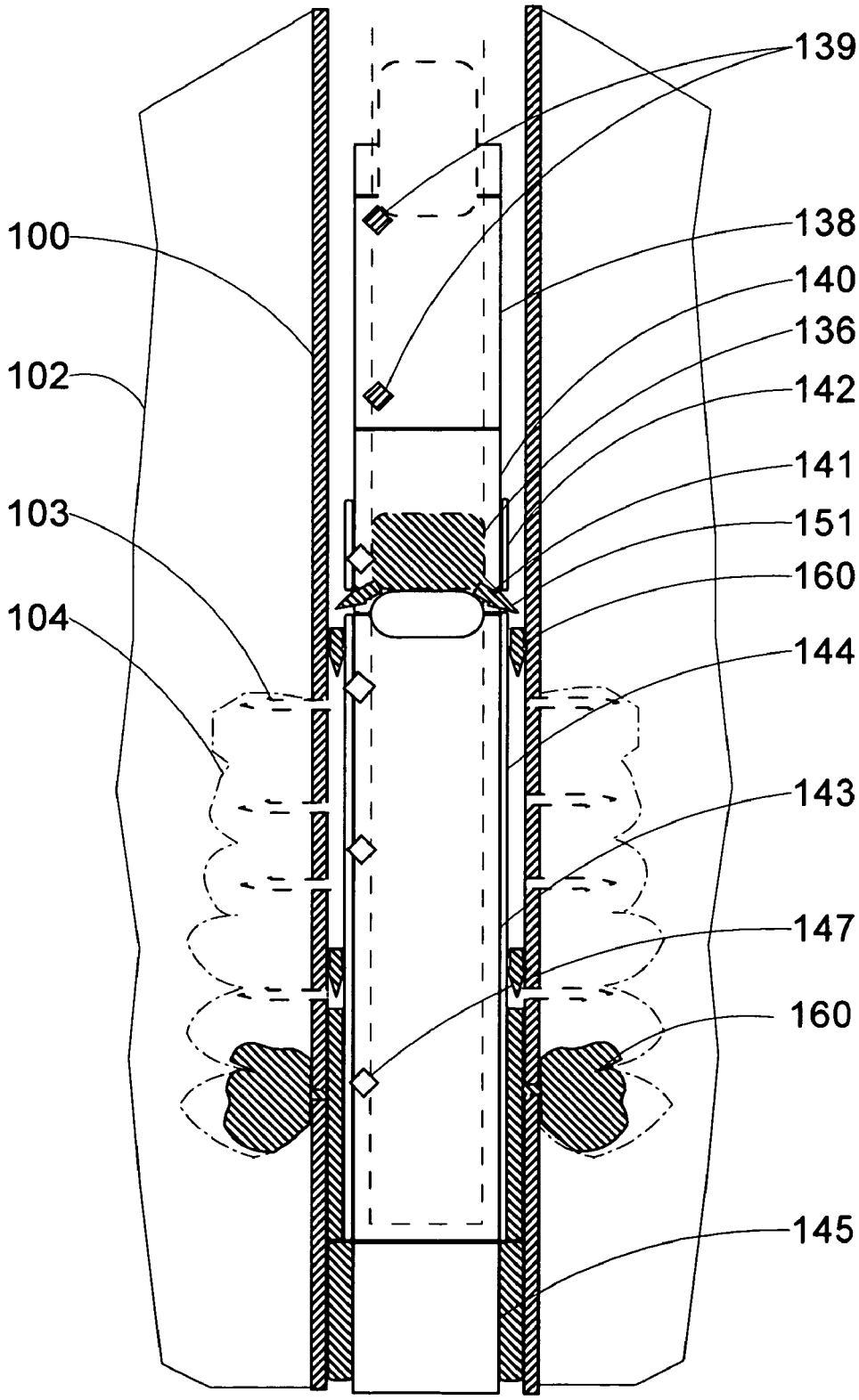
FIG. 6 illustrates the process of melting and partial penetration of alloy into a heated zone encompassing well perforations and earth formation channels.

FIG. 6 illustrates the downhole tool 110 with the expansion bridge plug 145 in the expanded position supporting a pool of molten alloy 160 partially penetrating the casing perforations 103 and formation zone 104. The alloy flow valve 141 is shown in the position to allow molten alloy 160 to flow to the outside of the zone heating module 143.

Figure 7:
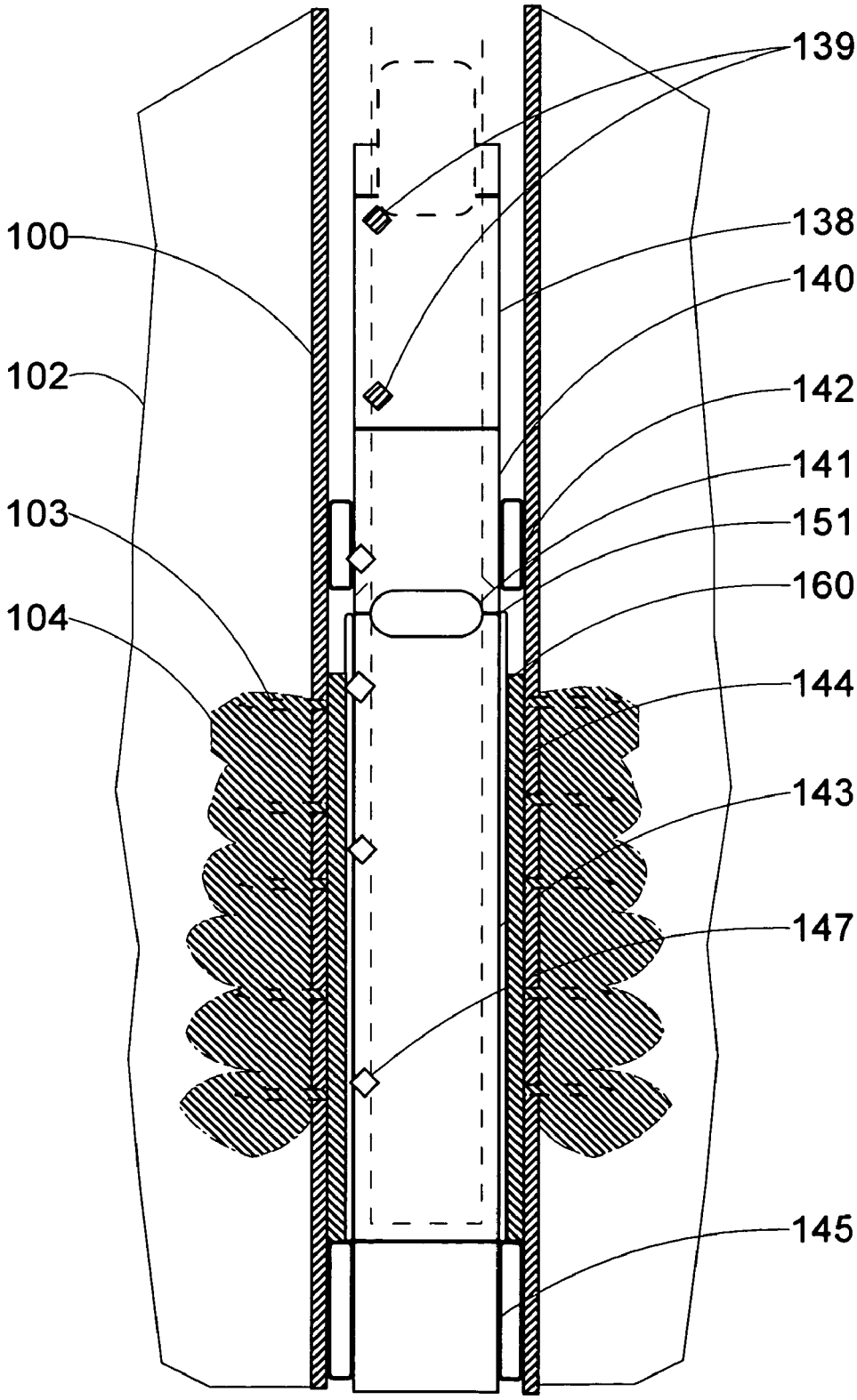
FIG. 7 illustrates the process of melting and full penetration of alloy into a heated zone encompassing well perforations and earth formation channels.

FIG. 7 illustrates the downhole tool 110 with the expansion bridge plug 145 in the expanded position supporting a pool of molten alloy 160 fully penetrating the casing perforations 103 and the heated formation zone 104. The alloy flow valve 141 is shown in the position to allow molten alloy 160 to flow to the outside of the zone heating module 143.

Figure 8:
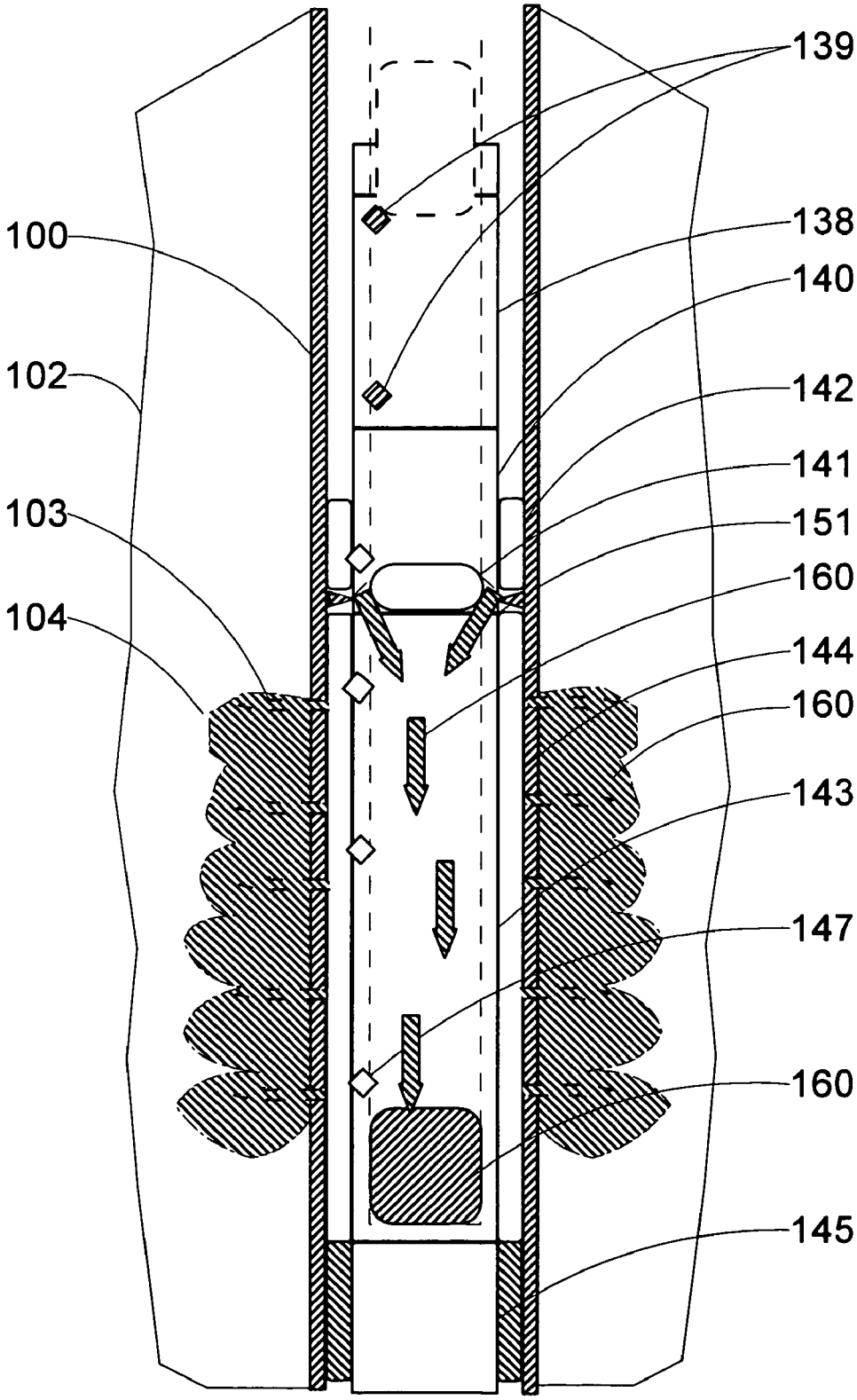
FIG. 8 illustrates the downhole tool in the process of squeezing molten alloy from the annulus between the casing inside surface and the tool.

FIG. 8 illustrates the downhole tool 110 with the expansion bridge plug 145, expansion squeeze sleeve 144 and expansion collar 142 in the expanded positions. Expansion of the squeeze sleeve 144 causes the flow of displaced molten alloy 160 through overflow portals 151 located at the top end of zone heating module 143 where it is received and retained for recovery subsequent to tool extraction. The alloy flow valve 141 is shown in the position to allow molten alloy 160 to flow into and be received and accumulated within the zone heating module 143.

Figure 9:
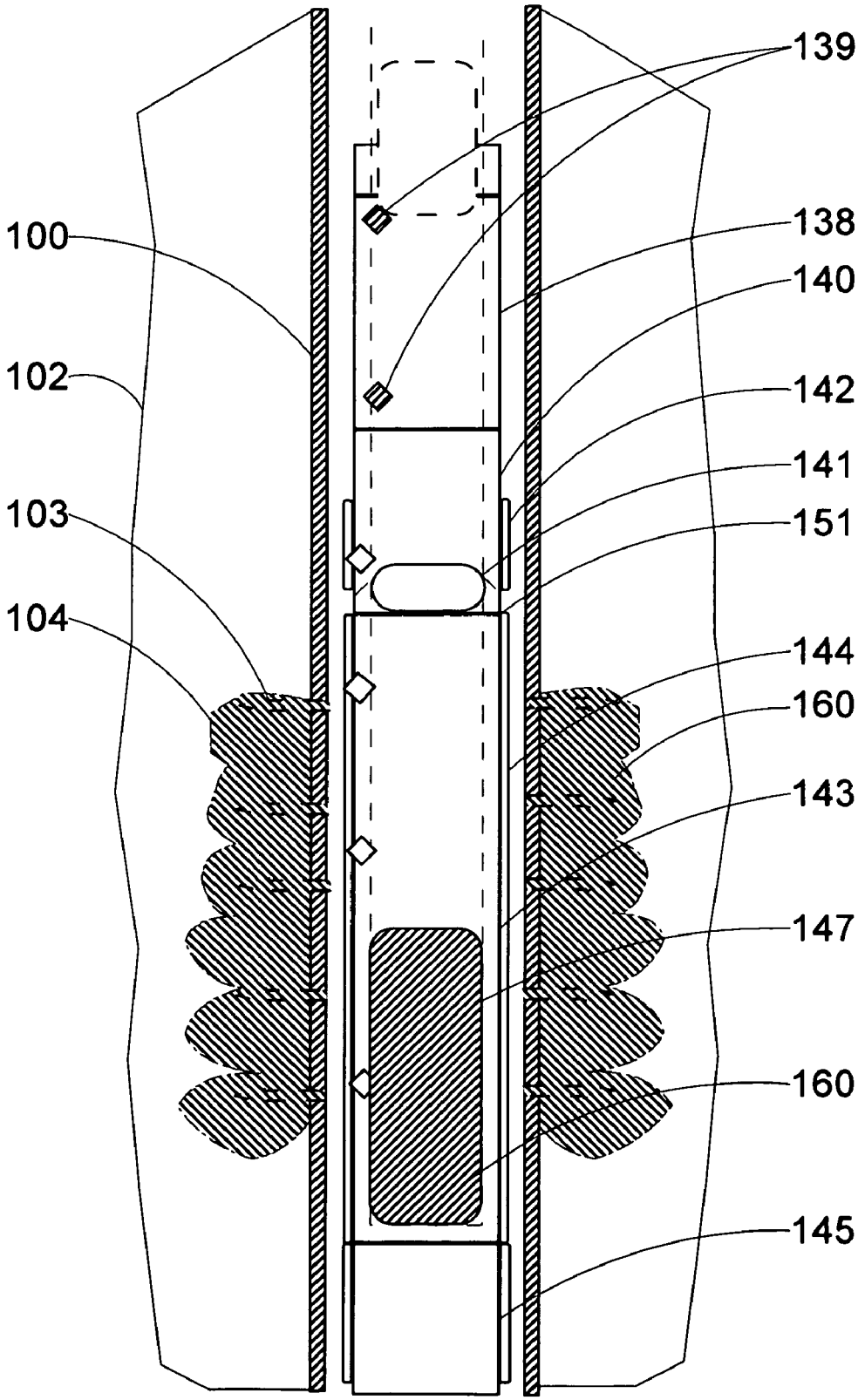
FIG. 9 illustrates the process of the expansion sleeve retracted subsequent to alloy solidification.

FIG. 9 illustrates the downhole tool 110 with the expansion bridge plug 145, the expansion squeeze sleeve 144 and expansion collar 142 in their respective retracted positions subsequent to alloy solidification.

Figure 10:
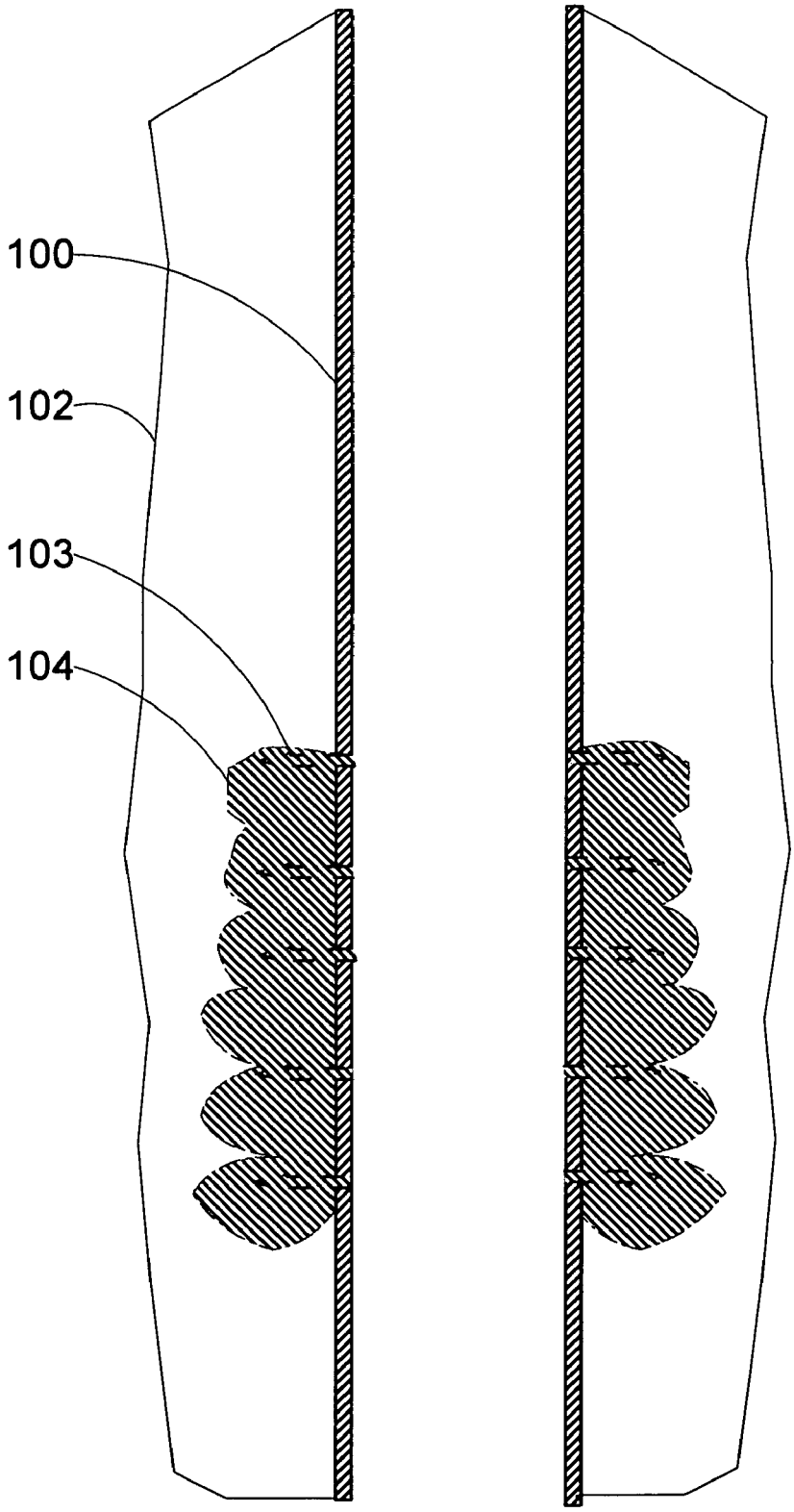
FIG. 10 illustrates the final casing plug formed after the tool is retracted.

FIG. 10 illustrates the final solidified casing plug formed in the perforation zone 104 after the tool 110 is retracted.

Figure 11A:
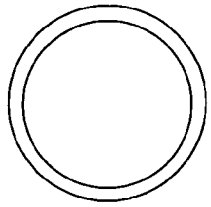
FIG. 11-A illustrates an alloy material supplied in billet form.
Figure 11A:
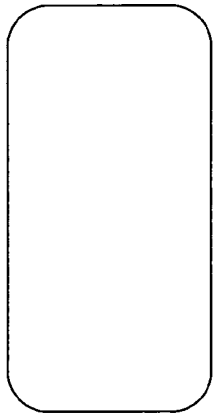
Figure 11B:
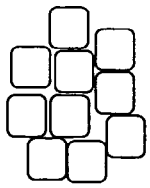

FIG. 11A illustrates a preferred embodiment of a dimensionally fabricated alloy billet which provides for ease of handling and reliable dispensing. Alternatively, FIG. 11B illustrates alloy material provided in pellet form.

Figure 12:
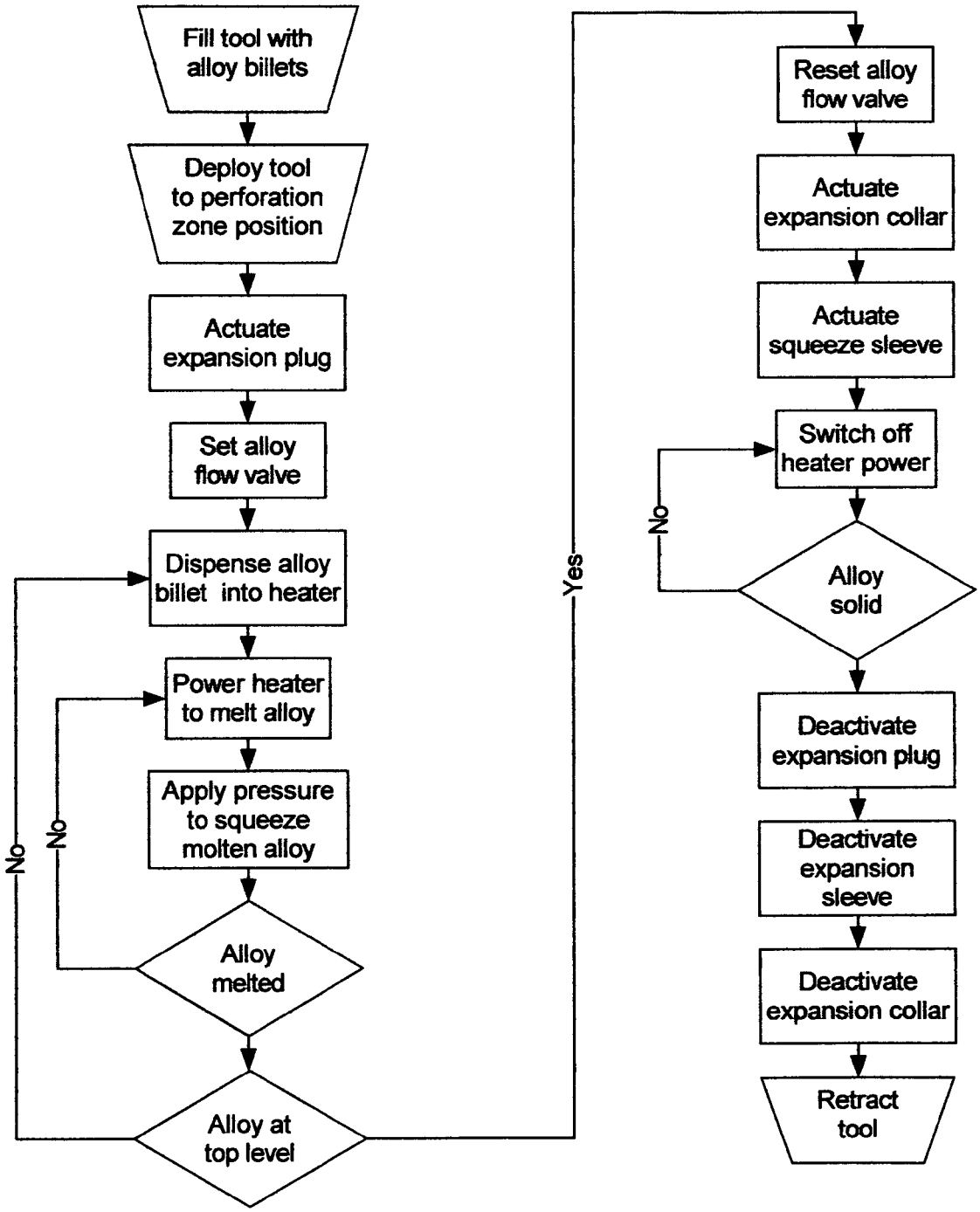
FIG. 12 is a process sequence flowchart describing the basic operation of the apparatus.

FIG. 12 is a simplified process description flowchart of a preferred embodiment as described herein.

METHOD OF OPERATION

Preferred Embodiment

The present invention is useful for plugging perforations in an operational well that includes one or more of the following conditions:

a. a single casing or a plurality of concentric casings positioned within a wellbore.
b. non-intentional perforations or damage caused by corrosion, drill abrasion, earth movement, pressure bursting or other factors that are considered detrimental to the operational purposes of the well.
c. intentional perforations specified for the purpose to allow ingress of gas or fluids from the wellbore formation into the central production casing.
d. leakage through casing collars or couplings used to connect casing sections.

The downhole tool 110 is prepared for deployment into a well by connection to the wireline 114 and loading a quantity of alloy billets 136 into the billet magazine 137 through the billet magazine loader 135. Alternatively, the alloy material may be supplied as pellets or in wire form with appropriate mechanisms provided to control and direct the dispensing of the material as required. The total quantity of alloy to be supplied depends on the expected volume to be filled in the perforated casing and wellbore within the heated perforation zone 104.

The downhole tool 110 is deployed through the well lubricator 116 and into the well casing 100 to a desired depth using conventional industry techniques, and positioned adjacent to the casing perforations 103 to be plugged. Said position would have the expansion bridge plug 145 to be located a few inches below the bottommost perforation.

Upon a telemetry command initiated by an operator, the expansion bridge plug 145, comprised of an inflatable bladder, is actuated to expand to form a seal against the casing inside surface. An alloy billet 136 is then dispensed by the billet dispenser 138 into the billet melting heating module 4-30 140 and electric power controlled by the PCU 111 is applied to melt the billet. The melted alloy flow control valve 141 is commanded to cause melted alloy 160 to be routed from the billet melting heater to the outside of the tool zone heating module 143. Electric power is also simultaneously applied to the zone heating module 143 to beneficially heat the perforation zone 104 to achieve a temperature to maintain a desired mass of molten alloy 160.

As the billet located in the billet melting heating module 140 proceeds to melt, melted alloy flows down to accumulate as a molten pool above the bridge plug 145 and about the expansion squeeze sleeve 144 whereupon it flows through perforations 103 and also beneficially saturates into the heated permeable perforation zone 104 surrounding the casing.

Level sensors 147 incorporated in the zone heating module 143 determine the top of the molten alloy pool 160 in order to control the dispensing of additional alloy billets 136 to be melted. Said level sensors are of the inductive type which have been found to satisfactorily discriminate between molten metal alloy and typical well fluids such as water. The inductive sense coils can also be conveniently located remotely from their signal conditioning electronics and can be constructed to reliably function at the temperature of molten alloy.

Alloy billets 136 are singularly dispensed into the billet melting heating module 140 by sequential actuation of the upper and lower dispense latches 139.

During the melting process, billets are dispensed such that the level of molten alloy 160 is maintained below the overflow portals 151 located at the top end of the zone heating module 143.

During the melting process, the operator may send a command to the downhole tool 110 to actuate an integrated electromechanical vibration module 150 as a means to motivate molten alloy 160 through the casing perforations 103 and to saturate the permeable heated formation zone 104.

During the melting process, the operator may command that a specified pressure supplied by an external pressure source 118 and controlled by an external pressure valve 119 be applied to the well casing 100 as a means to further motivate penetration of the molten alloy 160 through the casing perforations 103 and to saturate the permeable heated formation zone 104. Said pressure may be either a pressurized gas such as air, or a fluid such as water supplied at the well surface.

Determination of the completion of the process is based telemetry data transmitted from the downhole tool 110. These parameters include temperatures sensed at the downhole tool, the time period and quantity of power applied to melt the alloy, the volume of alloy dispensed, the estimated casing and perforation volume to fill, the height of the molten alloy, formation thermal characteristics, etc.

Once a sufficient volume of alloy has been melted and the decision is made to complete the process, a command is sent to the tool 110 to actuate expansion of the squeeze sleeve 144, expansion of the collar 142 and to redirect the alloy flow valve 141. The squeeze sleeve 144 and expansion collar 142 are each comprised of inflatable bladders. The expanded squeeze sleeve 144 then presses uniformly against the inside surface of the casing 100 thereby causing molten alloy 160 to be displaced upward and thereby flow through overflow portals 151 provided in the zone heating module 143. Excess molten alloy is thereby directed by the alloy flow valve 141 into the central bore of the zone heating module 143 where it is captured for recovery. The collar 142 beneficially prevents any molten alloy 160 from flowing upward beyond the overflow portals 151 to an unheated section of the tool.

Once the squeeze sleeve 144 is fully expanded, electrical power supplied to the downhole tool billet melting heating module 140 and zone heating module 143 is switched off in order to allow the molten alloy to cool and solidify. Downhole temperature telemetry data is monitored in order to determine when the alloy attains solidification.

Once the temperatures measured at the downhole tool 110 drop a point to ensure the alloy has solidified, a command is sent to the tool 110 to retract the expansion collar 142, to retract the expansion squeeze sleeve 144 and to retract the expansion bridge plug 145, whereupon the tool 110 is extracted from the well casing 100. Removal of the tool then leaves all casing perforations 103 plugged while the inside volume of the casing 100 is left clear and flush to the net inside surface bore of the production casing.

During extraction of the tool 110 from the plugged location, tension on the wireline 114 as measured by the strain sensor 149 is used to ensure tension exerted on the wireline is kept within operational stress limits and that the tool is clear and not frozen in place by alloy that may have detrimentally solidified within the casing 100 or by other interfering obstructions within said casing.

After tool extraction from the well at the surface 101, recovered alloy is melted and drained from the tool 110 by applying electric power to the zone heating module 143.

The diameter of the downhole tool 110 is scalable to accommodate different casing sizes. The length of the downhole tool 110 is determined as required to provide adequate length of heated zone and to store sufficient amount of alloy billets 136 in the billet magazine 137.

Embodiments of methods and apparatus to plug perforations and to seal leaks in a well casing have been described. In the description, for purposes of explanation, numerous specific details are set forth to provide a thorough understanding of the present invention. It will be appreciated, however, by one skilled in the art that the present invention may be practiced without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the present invention.

In the foregoing detailed description, apparatus and methods in accordance with embodiments of the present invention have been described with reference to specific exemplary embodiments. Accordingly, the present specification and figures are to be regarded as illustrative rather than restrictive.

I claim:

1. A method to seal well casing perforations and fluidic channels between said casing and surrounding wellbore formation utilizing a fusible metal alloy material, whereby the inside bore surface of the alloy sealing material upon re-solidification is left flush to the net casing bore surface after the completion of a single pass deployment process utilizing a wireline suspended downhole tool whereby:

a control and telemetry electronics system provides two way, data and command serial communication between a topside power control unit and the downhole tool; and at least one independently controlled electric heater is configured to melt metal alloy material and to heat the wellbore formation zone surrounding said well casing; and a dispenser mechanism to carry a supply of solid metal alloy material and selectively dispense the same for melting; and at least one independently actuated inflatable bladder to expand and retract by means of an actuation source contained within the tool; and wherein the tool comprises overflow portals configured to recover and remove excess amounts of said alloy upon extraction of said downhole tool;

wherein the following sequence is performed:

said downhole tool is lowered as an assembly into said well casing by means of a wireline; and upon reaching a desired location within the casing, one of said at least one inflatable bladder located a bottom of said tool is inflated to expand to form a temporary plug; and a quantity of alloy material contained in said downhole tool is dispensed into said at least one heater which is energized to melt said alloy material and to radially heat the surrounding casing and wellbore formation to a desired temperature to thereby form a molten alloy mass surrounding the downhole tool, casing perforations and space between the casing and the surrounding wellbore formation; and upon a accumulating a desired quantity of molten alloy between said downhole tool and said well casing, another one or more of said at least one bladders are inflated within the space between the tool and casing bore surfaces to squeeze and thereby displace the molten alloy upwards between said downhole tool and the inside surface of said well casing and;

upwardly displaced molten alloy is allowed to spill through overflow portals and into a receptacle contained within said downhole tool for subsequent removal as excess material; and while said one or more bladders are inflated to squeeze and displace said molten alloy, said alloy melting heater is de-energized thereby allowing the alloy to cool and solidify; and upon resolidification of the alloy, said inflated bladder, which formed said temporary plug is deflated, thereby allowing said downhole tool to be removed from the well casing while leaving well casing perforations sealed flush to net bore surface.

2. The method of claim 1 whereby vibration is generated by said downhole tool in order to motivate the progression of said molten alloy within said casing volume and through said casing perforations and about said casing within the heated zone of the formation.

3. The method of claim 1 whereby an externally supplied and controlled fluidic pressure is applied to the internal volume of said casing for the purpose to motivate the progression of said molten alloy within said casing volume and through said casing perforations and about said casing within the selected heated zone of the formation.

4. Apparatus to seal well casing perforations and fluidic channels between said casing and a surrounding wellbore formation utilizing a fusible metal alloy material, whereby the inside bore surface of the alloy sealing material upon re-solidification is left flush to the net casing bore surface after the completion of a single pass deployment process utilizing a wireline suspended downhole tool whereby said tool comprises:

a control and telemetry electronics system configured to enable two way communication between a control unit located at the surface and said downhole tool; and at least one independently controlled electric heater configured to melt metal alloy material and to heat the wellbore formation zone surrounding said well casing; and a dispenser mechanism to carry a supply of solid metal alloy material and selectively dispense the same for melting; and at least one independently actuated inflatable bladder to expand and retract by means of an actuation source contained within the tool, wherein at least one of the at least one bladder is configured to displace melted metal alloy; and overflow portals to recover and remove excess amounts of said alloy upon extraction of said downhole tool.

5. The apparatus of claim 4 wherein said heater is comprised of at least one of or a combination of electromagnetic induction or electrical resistance types heaters.

6. The apparatus of claim 5 wherein said heater includes at least one heater configured to melt alloy material and at least one heater configured to heat the well casing and the wellbore formation.

7. The apparatus of claim 4 wherein said wireline is a used to physically suspend said downhole tool, and to supply electric power to energize said at least one heater and to provide a means for electronic communication between said downhole tool and said control unit.

8. The apparatus of claim 4 wherein said fusible metal alloy is dimensionally fabricated into a particular geometric form as for the convenient handling, deployment and controlled dispensing thereof into said downhole tool heater for melting.

9. The apparatus of claim 7 wherein said metal alloy used is in the form of pellets.

10. The apparatus of claim 7 wherein said metal alloy used is in the form of a wire.

11. The apparatus of claim 7 wherein said metal alloy used is an eutectic alloy.

12. The apparatus of claim 4 wherein said at least one bladder is mounted at a bottom of the downhole tool and is configured to expand and form a temporary, integrated expansion bridge plug to support a volume of molten alloy contained above the plug and within the annulus between said downhole tool and casing surface.

13. The apparatus of claim 4 wherein said at least one bladder is configured to inflated to fill the annular space between the inside surface of the casing and the outside surface of the downhole tool to thereby displace molten alloy.

14. The apparatus of claim 4 wherein said at least one bladders is configured to be expanded as a means to press against the inside surface of the casing in order to maintain displacement of molten alloy within said casing perforations until after alloy re-solidification.

15. The apparatus of claim 14 whereby said displaced molten alloy may be routed by means of said at least one inflatable bladder into an interior space of said downhole tool for retrieval.

16. The apparatus of claim 4 wherein a said dispenser mechanism controls the deposit of specific amounts of alloy material into said heater for melting.

17. The apparatus of claim 4 whereby said alloy material is stored within said downhole tool to be dispensed to said heater section for melting.

18. The apparatus of claim 4 wherein a magazine loader serves to allow manual loading of said solid alloy material into the downhole tool for delivery into the well.

19. The apparatus of claim 4 wherein said at least one bladder is inflated by means of hydraulic fluid pressure as provided by an integrated hydraulic pumping system.

20. The apparatus of claim 4 wherein said at least one bladder is inflated by hydraulic fluid pressure as supplied from the well surface.

21. The apparatus of claim 4 wherein at least one sensor is provided to monitor the position of the level of the molten alloy within the annulus between said downhole tool and said casing.

22. The apparatus of claim 4 wherein at least one sensor is provided to monitor the temperature of the downhole tool and surrounding alloy material.

23. The apparatus of claim 4 wherein at least one sensors is provided to monitor downhole pressure.

24. The apparatus of claim 21 wherein said alloy level sensors are of the inductive type.

25. The apparatus of claim 4 wherein at least one sensor is provided in said downhole tool to monitor electrical current and voltage.

26. The apparatus of claim 4 wherein at least one sensor is provided to monitor the tension imposed on said wireline due to the combined weight of said downhole tool and said solid alloy material supply.

27. The apparatus of claim 4 wherein said at least one bladder is mechanically actuated.

28. The apparatus of claim 4 wherein the downhole tool includes a set of sensors and integrated telemetry electronics to transmit parametric data to said control unit located at the well surface.

29. The apparatus of claim 4 wherein said at least one bladder is fabricated from an elastic material and constructed to provide adequate thermal conductivity to heat said alloy above its melting temperature.

* * * * *